United States Patent [19]

Keim

[11] 4,067,363

[45] Jan. 10, 1978

[54] SHEDDING DEVICE FOR WEAVING LOOMS, IN PARTICULAR FOR DOUBLE-LIFT OPEN-SHED JACQUARD MACHINES

[75] Inventor: Walter Keim, Gerlenhofen, Germany

[73] Assignee: Firma Gross Webereimaschinen GmbH, Neu-Ulm (Donau), Germany

[21] Appl. No.: 708,086

[22] Filed: July 23, 1976

[30] Foreign Application Priority Data

July 25, 1975 Germany ..... 2533216

[51] Int. Cl.[2] ..... D03C 3/00; D03C 3/08

[52] U.S. Cl. ..... 139/59; 139/65

[58] Field of Search ..... 139/59–65, 139/85

[56] References Cited

U.S. PATENT DOCUMENTS

| | | | |
|---|---|---|---|
| 2,045,162 | 6/1936 | Petzoldt | 139/65 |
| 3,289,707 | 12/1966 | Wittendal | 139/63 |
| 3,455,339 | 7/1969 | Seiler | 139/65 X |
| 3,835,895 | 9/1974 | Bassi | 139/65 |
| 3,967,652 | 7/1976 | Seiler | 139/65 X |
| 4,022,251 | 5/1977 | Bucher | 139/59 |

FOREIGN PATENT DOCUMENTS

| | | | |
|---|---|---|---|
| 2,455,035 | 5/1975 | Germany | 139/65 |
| 207,350 | 11/1923 | United Kingdom | 139/59 |

*Primary Examiner*—James Kee Chi
*Attorney, Agent, or Firm*—Karl F. Ross

[57] ABSTRACT

A shedding device for a double-lift open-shed Jacquard loom which comprises a pair of vertically shiftable horizontal blades adapted to pass each other and cooperating with lifters which are provided with projection in opposite directions respectively engageable by the blades. The blades of each are provided with spaced apart lifter-engaging surfaces adapted to engage the respective projection upon upward movement but to deflect the lifter away upon downward movement past the projections. Between these spaced apart surfaces of the blades, the blades are incapable of engaging the lifters and the lifters can be shifted transversely to the blades to position them in line with an inclined engaging surface of the blade or in a region between such engaging surfaces.

10 Claims, 7 Drawing Figures

Figure 1:
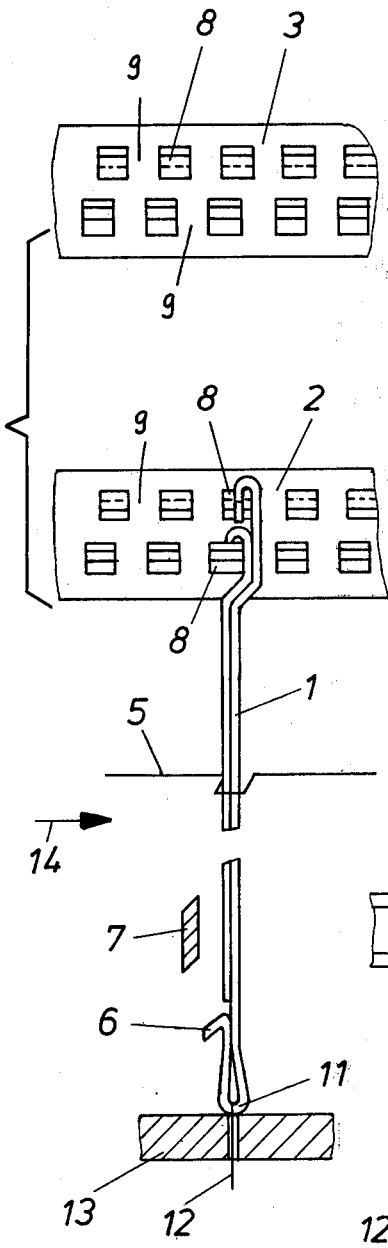

SHEDDING DEVICE FOR WEAVING LOOMS, IN PARTICULAR FOR DOUBLE-LIFT OPEN-SHED JACQUARD MACHINES

The invention relates to a shedding device for a weaving loom and more particularly to double-lift open-shed jacquards, with two double-motion lifting bars passing each other, with lifters controllable by main needles and provided with two main hooks assigned to movable double-motion knives, blades or griffes and, when required, a stop hook assigned to the stop blade.

The lifters of known double-lift open-shed Jacquard machines are of a two-legged design. They have a main hook on each leg and, in addition, on one of their legs a stop hook. The main hooks are assigned to the double-motion griffes of the lifting bars. The stop hook serves the purpose of setting the lifters in their raised position on a stationary stop blade, in order to enable them to remain in the upper shed position. When the lifting bars are telescoped and the double-motion griffes pass each other, care must be taken that a lifter moving from the raised into the lowered position cannot be seized by the rising griffe. In order to fulfill this condition with complete safety, the influence of the main needle on the lifter must be maintained up to the point in time, at which the crossing of the lifting bars takes place. This results in unfavorable movement conditions for the thread insertion mechanism which has to move the main needles according to the cards. The DT-OS 2,316,649 (German Patent Disclosure) equivalent to U.S. Pat. No. 3,835,895 reveals a suggested solution overcoming this disadvantage, according to which the two main hooks of a one-bar lifter, which may be rotated about its longitudinal axis, are arranged staggered in relation to each other by an angle of about 90°, causing the corresponding main hook to position itself in a longitudinal plane of the Jacquard machine, when the lifter is raised by one of the two lifting bars, while the other main hook, due to the avertence of the lifter about its longitudinal axis, lies in a laterally swung-out position, whereby at least one additional hook is provided in the bisectrix of the angle between the two main hooks, which interacts on the one hand with the stationary lifting bar for the open shed position and on the other hand with a second fixed guide bar having the function to stop the lifters in lowered position.

In this design, the constant sliding of the main hooks on the lifting griffes causes a not insignificant wear, particularly since the hooks must be of cylindrical shape; in order to offer the least possible resistance to the rotating glide motion. Up to the final functional position after a turn of about 45° with line contact, only a point contact takes place. In addition, the constant oscillating rotation of the lifter about its longitudinal axis exerts a disadvantageous effect on the strap suspended from it and on the harness cord with heddle, which have the tendency to follow this rotation.

The invention has as its object to avoid the drawback of the double-lift open-shed Jacquard machine, without having to accept the difficulties arising from the construction of the design pursuant to DT-OS 2,316,649 (German Patent Disclosure). The invention thus provides a shedding device for a weaving machine of very simple and space-saving design, in which the control movement of the main needles and lifters can be substantially reduced despite blades passing each other, and the thread insertion movement is effected in a more harmonious manner to give a considerable increase in machine performance.

Taking the known double-lift open-shed Jacquard machine mentioned at the start as a point of departure, the invention lies in the fact that the blades are arranged in parallel to the main needles and are equipped with drive elements spaced at intervals in the longitudinal direction of the blades or griffe and serving to receive the main hooks of the lifters, and that the lifters along the blades may be shifted up to the region located between the driving elements.

The individual lifter is thus displaced by the main needles along the longitudinal axis of the individual blade, while in known double-lift open-shed Jacquard machines this control movement takes place perpendicular to the longitudinal axis of the cutters. Accordingly, the drive elements of the blades or griffes must be designed together with the main hooks of the lifters in such a way that the driving surface can engage the assigned main hook of the lifter on its underside and take it along, if the latter is to change its shedding position. As a result of the load suspended from the lifter, the main hook sitting on the driving surface slides all the way on the latter with the result that the lifter approaches the blade, and, respectively, abuts on the latter, while the free main hook leaves the region of movement of the other movable double-motion cutter. When, however, the main hook of the lifter comes to rest between the driving elements of the blade, then the lifter stays in its original position.

This has the advantage that the lifter may be simply designed, resulting in a dynamic improvement of the machine motion and in substantial savings. Overall, the performance of the Jacquard machine can be increased substantially by this basic conception. Beyond that, it provides a looser form of construction of the lifters compared to the known Jacquard machines because their pitch corresponds to that of the cutters.

In a first embodiment of the invention cited by way of example, the individual blade has on each side a row of laterally corbelling driving elements, with recesses in the blade provided above the latter which are engaged by the driven main hooks. It is expedient if the driving elements and the recesses are formed by stamped and angular flaps, the lower edge of which is wedge-shaped. In addition, the two rows of the driving elements may be arranged one below the other and, if need be, also staggered in relation to each other.

This form of construction as cited by way of example is distinguished by a very inexpensive design of the blades and offers the possibility of using flat lifters with main hooks corbelling in a lateral direction. In order to enable these flat lifters to abut closely to the lateral surface of the blades, when they are driven, it is recommended to provide recesses underneath the main hooks.

This embodiment of the invention offers, however, also the possibility of employing lifters consisting of round bars. It has been found to be expedient; if the lifter is composed of two round bars which are connected to and abut on each other in the longitudinal direction of the blades, their upper edges being bent U-shaped and merging into obliquely declining main hooks running at right angles to the longitudinal direction of the blades. At the same time, this results in the advantageous strengthening of the lifters in their central area. As a result of the U-shaped deflection of the upper edges a free space is created below the main hooks, into which the driving elements enter, thus engaging it, so that in this case too the driven lifter is pulled towards the blade and removed from the area of influence of the double-motion blade.

In a second embodiment the same task pursuant to the invention is attained by another design of the blades. In this case the upper edge of the blades exhibits driving elements formed by bevels, with deflecting surfaces beveled on the opposite side provided between the driving elements, whereby the beveling begins always at the blade's edge. The width of both of the main hooks of a lifter may hereby be greater than the inside distance of two adjacent blades, whereby the slope of the driving surfaces and main hooks is of such a magnitude that a main hook driven by the blade glides along the driving surface under the traction weight until the lifter abuts the blade and is freed from the double-motion blade.

The main hooks of the lifter are designed advantageously in an arrow tip-like shape at their upper end. For the purpose of this invention it is especially advantageous, if the lifter is designed as a flat lifter and if it can be moved by the main needles in the direction of its greater bridge height. This creates the prerequisite for extraordinary vibration stability of the lifter as well as for a high number of revolutions.

The beveling of the main hooks may be kept relatively flat, since it does not have to effect a rotation as in the aforementioned state of the art, but only an effective gliding of the hook on the driving surface. The prerequisite of slight thread insertion play existing in fast-running Jacquard machines is thus fulfilled to a wide degree.

Within the framework of the embodiment of the invention cited by way of example, the lower edge of the movable blades is rounded off, shaped wedge-like or provided with deflecting bevels. This design acts as a deflecting surface in case the descending blade has to pass the main hook of the lifter in the lower rest position, which is assigned to it.

Otherwise, it is practical to round off the lower edge of the lifter and to brace it flexibly against the lifter bottom. This serves to bring about a state of inaction in the lower base position during the push-off movement.

Figure 2:
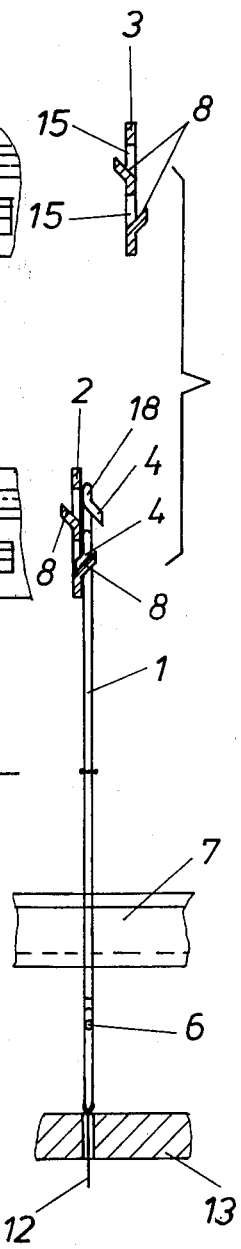
Figure 3:
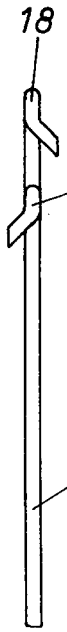
Figure 4:
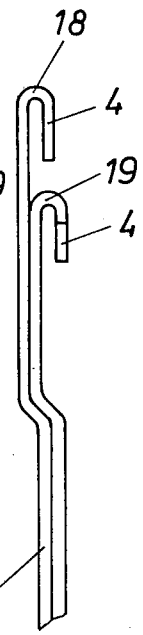
Figure 5:
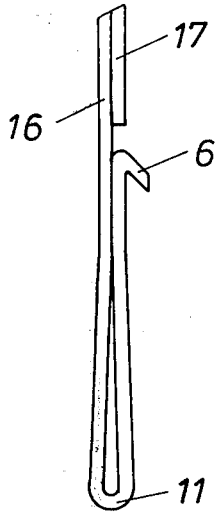
Figure 6:
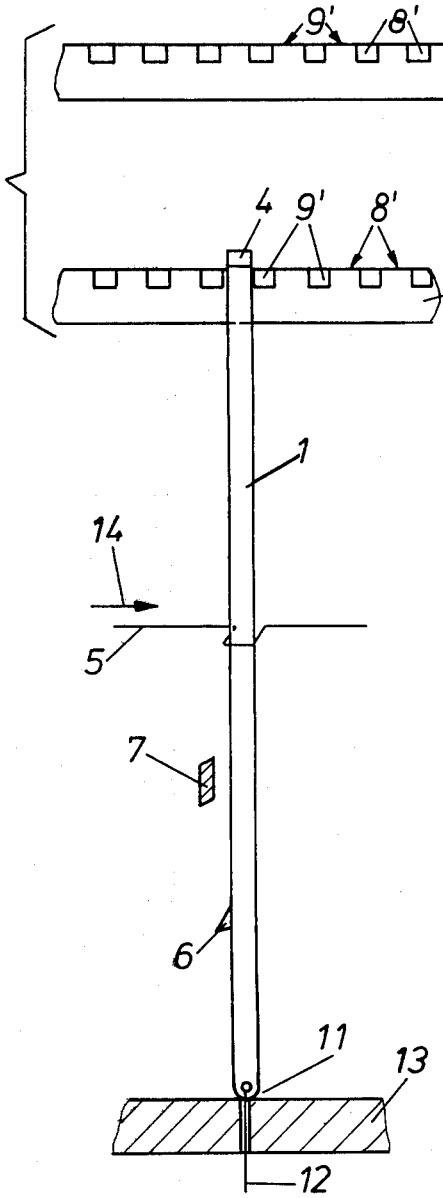
Figure 7:
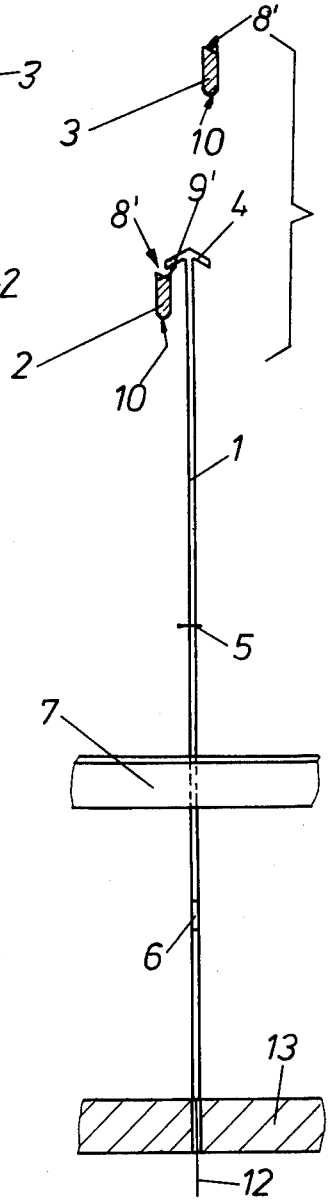

Details of the invention are illustrated in the drawing. The latter shows the invention in diagrammatic representation and by way of example, as follows:

FIG. 1: a diagrammatic representation of the movable lifting bars with a lifter movable in parallel to the latter, in a double-lift open-shed Jacquard machine, FIG. 2: a frontal view of the arrangement pursuant to FIG. 1, FIG. 3: a profile of the two-bar lifter, FIG. 4: a frontal view of the upper part of the lifter pursuant to FIGS. 3, FIG. 5: a frontal view of the lower part of the lifter pursuant to FIGS. 3 and 4, FIG. 6: a schematic representation of the movable lifting bars with a lifter movable in parallel to the latter, in a second embodiment cited by way of example, and FIG. 7: a frontal view of the arrangement pursuant to FIG. 6.

In the embodiments of FIGS. 1 and 2 relating to a double-lift open-shed Jacquard machine, 2 and 3 represent partial views of double-motion cutters passing each other and serving the purpose of lifting the lifters 1. The lifters may be constructed also of a single bar of flat material. They exhibit on their upper edge main hooks 4 arranged in opposite directions to each other, to be engaged underneath and driven by the blades 2, 3. The main needles, which are required for the control of the lifters 1 by the thread insertion device not shown in the drawing, extend parallel to the blades 2, 3. In the exemplified form of construction the longitudinal direction of the machine is indicated by the arrow 14. Both the blades 2, 3 and the main needles 5 extend in this direction of the arrow. The stationary stop blades 7, however, which function to detain a lifter 1 with the aid of the stop hooks 6 while the former is in an elevated position, in order to prevent the lifter 1 from descending with the associated cutter, are arranged at right angles to this direction.

The blades 2 and 3 consist of flat bars arranged in an upright position and are provided on both sides with one row of driving elements 8 each, spaced at intervals from each other in the longitudinal direction of the cutters, these driving elements having the function of engaging underneath and driving the main hooks 4 of the assigned lifters. The driving elements 8 are manufactured preferably by noncutting shaping, whereby recesses 15 are formed above them, which may be engaged by the main hooks 4 of the lifters 1. The upward pointing side of the driving elements 8 is designed as a continuous oblique surface at an angle permitting the main hook 4 to glide down alongside of it under the weight of traction when driven, causing the driven lifter 1 to approach the blade 2, 3 and abut on the latter. As a result, the main hook 4 on the opposite side is removed from the path of movement of the other blade 2, 3 assigned to it, and can therefore not be driven inadvertently into the upper shed position during a downward trend of movement, when the blades 2, 3 pass each other. The driving elements 8 arranged one beneath the other are staggered in the embodiment shown in FIGS. 1 and 2 by the thickness of one lifter bar 1. When flat lifters are employed, this stagger arrangement can be dispensed with. The push-off movement of the lifters 1 is accomplished in a longitudinal direction of the blades with the aid of the main needles 5. Empty spaces 9 are located between the driving elements 8 of the cutters 2, 3. If a main hook 4 of the lifter 1 is in position opposite the empty space 9, the lifter 1 cannot be raised by either of the blades 2, 3. The thread insertion movement of the lifters 1 is thus accomplished only by a slight tilting motion, without the requirement of bending the lifters 1.

FIGS. 3 to 5 show a round bar lifter 1 consisting of two lifter bars 16 and 17 connected with and abutting each other, whose upper edges 18, 19 are deflected U-shaped and merge with the mainhooks 4 which are offset to opposite sides. This construction of the edges 18, 19 should be carried out in such a way that the driving elements 8 will be positioned in the empty space under the main hooks 4. As a consequence, a driven lifter 1 can slide entirely into the recess 15 with its main hook 4 without hitting the edge of the driving element 8. In the lower range, one of the lifter bars 16 is of longer dimensions than the other, and bent U-shaped. Its free end merges with the stop hook 6.

Both the driving elements 8 and the hooks 4 and 6 are flattened at their free ends parallel to the cutter surfaces 2, 3, in order to avoid unnecessary projections.

In the second embodiment pursuant to FIGS. 6 and 7, the upper edge of the two blades 2, 3 is provided alternatingly with the driving surfaces 8′ and the deflecting surfaces 9′ which exhibit opposite inclines in relation to one another. The driving surface 8′ is arranged approximately parallel to the assigned leg of the main hook 4.

As illustrated especially in FIG. 7, this leg of the main hook 4 extends slightly beyond the upper edge of the driving surface 8'. When the blade 2 is elevated from its lower position, the external edge of the main hook 4 is caught on the edge area of the driving surface 8'. The lifter 1 is consequently taken to the top. However, since a traction load is suspended from the lifter 1, the leg of the main hook 4 slides entirely onto the driving surface 8', causing the lifter 1 to approach the blade 2, while the free leg of the main hook 4 departs from the path of movement of the descending cutter 3. If the lifter 1 is now lowered together with the blade 2 again from its upper position, the driving surface of the other blade 3, which is then on the ascent, is prevented in this way from seizing the free leg of the main hook 4.

When the lifter 1 is now moved by the main needles 5 in the direction of the arrow 14 by the amount of pitch of the driving and deflecting surfaces 8', 9' along the blades 2, 3, the main hook 4 enters the path of action of the deflecting surface 9' which, as shown in FIG. 7, is approximately parallel in slope to the leg averted from the blade 2, 3. When the blade 2 in the embodiment of FIG. 7 ascends, the main hook 4 slides laterally off the deflecting surface 9'. The lifter remains therefore in its original position, whereby the deflecting movement of the lifter 1 terminates already before the lower edge of the descending blade 3 establishes touch contact with the main hook 4. In order to make this contact as smooth as possible, the lower edge 10 of the cutters 2, 3 is rounded off. This lower edge may also be designed wedge-shaped or be provided with other deflecting inclines. In this embodiment, the rows of lifters 1 are staggered in an alternating manner and in proportion to the pitch of the driving and deflecting surfaces 8', 9'.

The lifter 1 is rounded off at its lower edge 11, by means of which it sits on the lifter bottom 13. This provides a kind of joint-like guidance for the lifter 1 with respect to its push-off movement pursuant to arrow 14, leading to additional smoothness of running and preventing a shift of the lifter 1 with its lower edge along the lifter-bottom 13. The traction load suspended from the strap 12 keeps the lifter 1 in the guide range of the bore penetrating the lifter-bottom 13.

I claim:

1. A shedding device for a double-lift open-shed Jacquard weaving loom, comprising:

an array of upright vertically displaceable lifters each having an upper end formed with a pair of oppositely extending downwardly inclined projections;

a pair of generally horizontal lifting blades flanking said array and each formed with a plurality of longitudinally spaced inclined surfaces respectively engageable with a projection of a respective lifter upon an upward movement of the respective blade rim to said lifters, said blades being each formed with regions between said surfaces permitting relative displacement of said lifters and said blades without mutual entrainment; and means for displacing said lifters laterally from a position in which a respective projection is engageable by a respective one of said surfaces of a respective blade and into an adjoining one of said regions for selectively enabling entrainment of said lifters by said blades during upward movement of the blades and preventing such entrainment.

2. The shedding device defined in claim 1 wherein each of said lifters is weighted and is formed with a respective stop hook below said projections, said stop hook being engageably by a stop blade extending along said array.

3. The device defined in claim 1 wherein said projections on each lifter are formed as main hooks at the upper extremity of each lifter, said hooks being bent from the plane of the array in opposite directions.

4. The device defined in claim 3 wherein each of said blades is formed with two rows of longitudinally spaced openings, the openings of said rows being longitudinally staggered with respect to one another, the said surfaces of each of said blades being formed as tongues projecting upwardly toward said array from the bottom edge of the opening of one of said rows.

5. The device defined in claim 4 wherein each of said lifters consists of a pair of round-section bars connected with one another and longitudinally abutting one another, upper edges of said bars being bent into said hooks.

6. The device defined in claim 4 wherein each of said lifters is a flat bar having said main hooks projecting in opposite directions and spaced apart along the length of the flat bar.

7. The device defined in claim 3 wherein said surfaces are formed as bevels along the upper edge of each of said blades, said regions being provided with deflecting surfaces beveled in the direction opposite the first-mentioned bevels.

8. The device defined in claim 7 wherein said hooks are formed with an arrow-tip configuration at the upper end of each of said lifters.

9. The device defined in claim 8 wherein the length of the hooks of each lifter is greater than the spacing between said blades.

10. The device defined in claim 1 wherein each of said blades has a rounded lower edge.

* * * * *